United States Patent [19]

Beachy et al.

[11] Patent Number: 4,899,932

[45] Date of Patent: Feb. 13, 1990

[54] CAPPED HIGHWAY GRADE CROSSING

[75] Inventors: Dale K. Beachy, Finleyville; Robert B. Dehls, McMurray, both of Pa.; S. Hudson Owen, Marshfield, Wis.; James H. Simpson, Sewickley, Pa.

[73] Assignee: Koppers Industries, Inc., Pittsburgh, Pa.

[21] Appl. No.: 183,055

[22] Filed: Apr. 19, 1988

Related U.S. Application Data

[63] Continuation-in-part of Ser. No. 409,079, Aug. 18, 1982, abandoned.

[51] Int. Cl.[4] ..... E01B 25/28

[52] U.S. Cl. ..... 238/8; 238/9

[58] Field of Search ..... 238/6, 7, 8, 9

[56] References Cited

U.S. PATENT DOCUMENTS

| | | | |
|---|---|---|---|
| 1,849,048 | 3/1932 | Crampton | 238/8 |
| 3,465,963 | 9/1969 | Caillet et al. | 232/8 |
| 4,232,823 | 11/1980 | Eggermann | 238/7 |
| 4,421,272 | 12/1983 | Whitlock | 238/8 |
| 4,445,640 | 5/1984 | Caillet | 238/9 X |
| 4,545,527 | 10/1985 | Young | 238/8 |

FOREIGN PATENT DOCUMENTS

| | | | |
|---|---|---|---|
| 0581848 | 8/1959 | Canada | 238/8 |

*Primary Examiner*—Andres Kashnikow
*Assistant Examiner*—Timothy Newholm
*Attorney, Agent, or Firm*—Herbert J. Zeh, Jr.; Rita M. Rooney

[57] ABSTRACT

An improved highway grade crossing for railroad tracks. The crossing is comprised of a plurality of wood panels which are capped with an expanded polymer. The polymer provides a wear surface for the crossing which can be replaced without having to take up the entire crossing structure. In one embodiment the polymer cap is a rubber and steel composite. The steel keeps the rubber stretched to substantially avoid temperature induced expansion and buckling of the rubber. Deterioration resulting from vehicular traffic over a buckled surface is thus avoided.

11 Claims, 4 Drawing Sheets

CAPPED HIGHWAY GRADE CROSSING

CROSS REFERENCE TO RELATED APPLICATION

This application is a continuation-in-part of a copending application Ser. No. 409,079 filed Aug. 18, 1982 now abandoned.

BACKGROUND OF THE INVENTION

1. Field of the Invention

The invention relates to highway railroad grade crossings and, more particularly, to a highway grade crossing having a removable and replaceable wear surface.

2. Brief Description of the Prior Art

Highway grade crossings are old and well known in the art. Highway crossings have been made from a variety of materials including wood, concrete, rubber and metal and in various configurations in an attempt to provide a smooth, safe and long-lived crossing for the highway over the rails of the track.

While prior art crossing designs have served with varying degrees of success, they share one drawback which has made them costly to maintain. All crossings have an upper surface which acts as a continuation of the highway over the rails. This surface is subject to wear from the volume of motor vehicle traffic which passes over it and as the surface wears it deteriorates and eventually can become a safety hazard. In all of the prior art crossing designs to rebuild the wear surface, it is necessary to remove and replace at least entire sections of the crossing, if not the entire crossing. The removal and replacement of the crossing structure is often a time consuming and expensive operation. In fact, the cost of such work has often caused delays in the repair of crossings because sufficient funds were not available.

SUMMARY OF THE INVENTION

The present invention overcomes the foregoing problems of the prior art by providing a crossing having a wear surface which can be replaced without disturbing any of the remainder of the crossing structure. The crossing of the present invention is comprised of a plurality of wooden panels which are adapted to be fixed to the rail crossties. The upper surface of the panels are capped to a predetermined height with a polyethylene which becomes the wear surface of the crossing. When the polyethylene material deteriorates, it can easily be removed and replaced without disturbing the panels or other elements of the crossing structure. In one embodiment the polymer cap is a rubber and steel composite. The steel keeps the rubber stretched to substantially avoid temperature induced expansion and buckling of the cap. Deterioration resulting from vehicular traffic over a buckled surface is thus avoided.

BRIEF DESCRIPTION OF THE DRAWINGS

The capped highway grade crossing of the present invention is further explained with reference to the attached drawings in which.

DESCRIPTION OF THE PREFERRED EMBODIMENT

Figure 1:
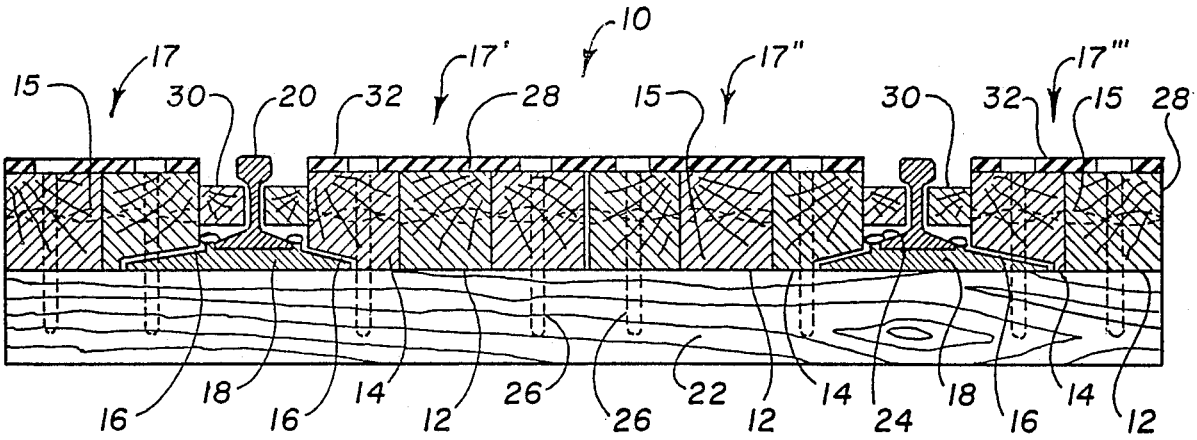
FIG. 1 is a cross sectional view through one embodiment of the crossing of the present invention.
Figure 2:
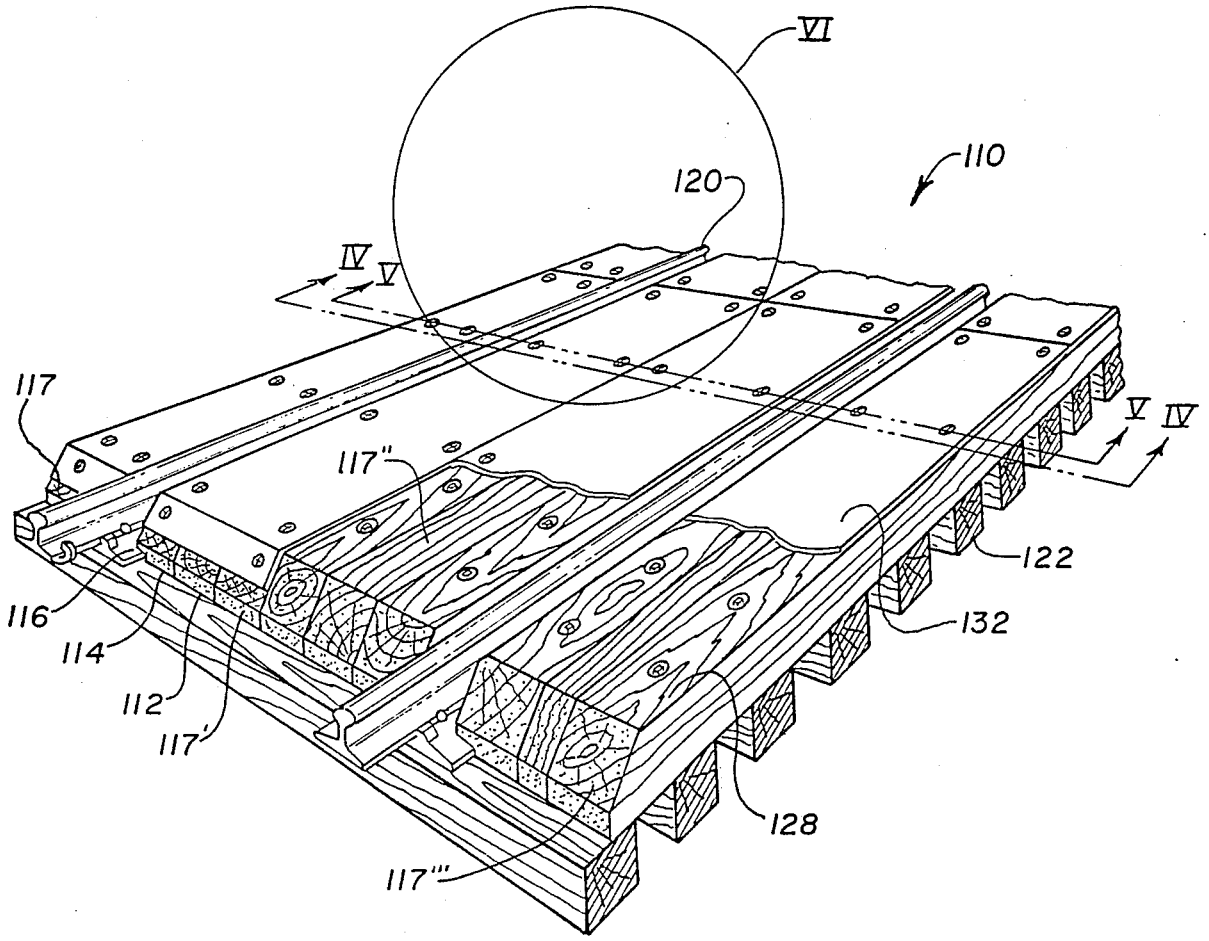
FIG. 2 is a cut away, isometric view of another embodiment of the crossing of the present invention.

Referring to FIG. 1, the crossing generally designated 10 is comprised of a plurality of wooden planks 12 and 14. In the preferred embodiment, each plank measures $7'' \times 8\frac{1}{2}'' \times 96''$ and planks 14 have notches 16 to receive standard tie plates 18 on which rails 20 are mounted. Planks 12 and 14 are joined by steel twist dowels 15 to form planks 17, 17', 17' and 17'''. It is understood that the panels may vary depending on the size and structure of the crossing. Tie plates 18 and rails 20 are operably fixed to crosstie 22 by means of spikes 24 in the conventional manner.

In the preferred embodiment planks 17, 17', 17'' and 17''' are fixed to crosstie 22 by means of washer head lag screws 26. Also provided are wood filler blocks 30 which span the gap between the rail and the panels. Surface 28 of the panels are capped with a 1" thick layer of polymer 32, such as polyethylene, which acts as the wear surface of the crossing. The polyethylene cap is removably fixed to surface 28 by means of a plurality of dome head spikes, not shown. It can be seen as the polyethylene deteriorates it can easily be removed and replaced without disturbing the planks or the panels. It is understood that the crossing of the present invention can be used at multiple track crossings by repeating the structure herein described for each set of tracks. Also, the width and length of the crossing will be determined by the dimensions where the crossing will be used.

Another embodiment of the crossing of the present invention is shown in FIGS. 2–7. Referring to these figures, the crossing generally designated 110 is comprised of a plurality of wood planks as at 112 and 114. Each plank preferably measures $7'' \times 8\frac{1}{2} \times 96''$ and planks as at 114 have notches as at 116 to receive standard tie plates as at 118 (FIGS. 4 and 5) on which rails as at 120 are mounted. Planks 112 and 114 are joined by steel twist dowels 115 (FIG. 4) and 119 (FIG. 5) to form planks 117, 117', 117'' and 117'''. The planks preferably form the panels shown in FIGS. 2–7. It is understood that the panels may vary depending on the size and structure of the crossing. Tie plates as at 118 and rails as at 120 are operably fixed to crosstie as at 122 by means of spikes as at 124 in the conventional manner.

Figure 3:
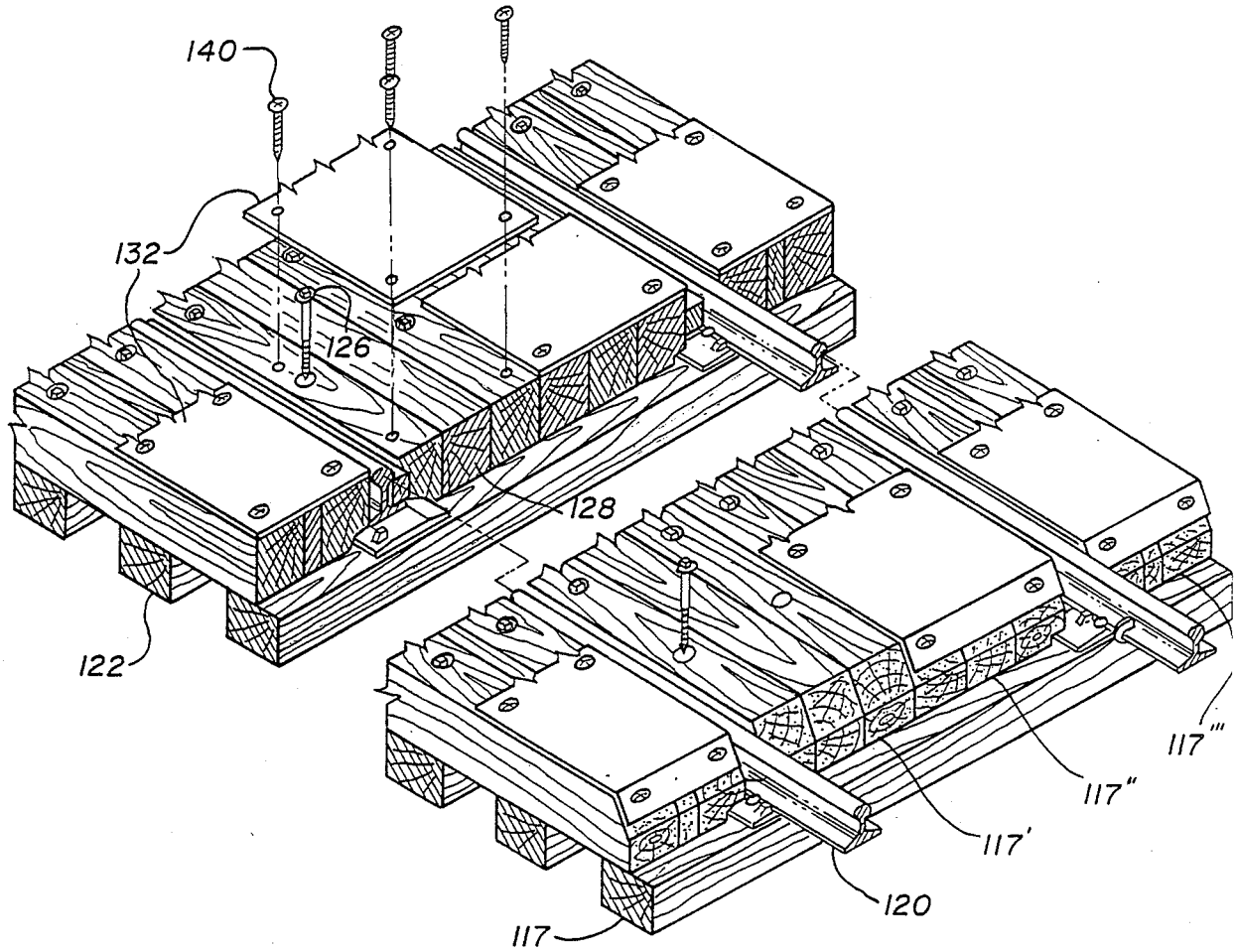
FIG. 3 is another cut away isometric view of the crossing shown in FIG. 2.
Figure 4:
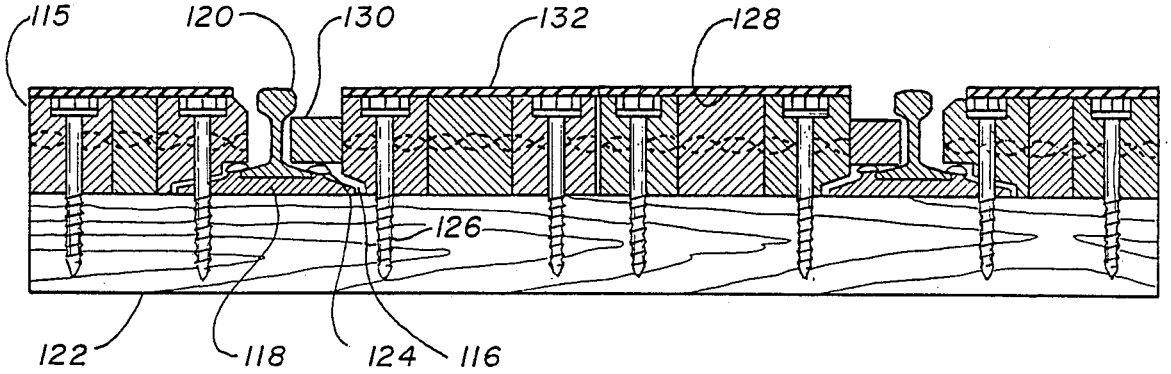
FIG. 4 is an enlarged cross sectional view taken through line IV—IV in FIG. 2.
Figure 5:
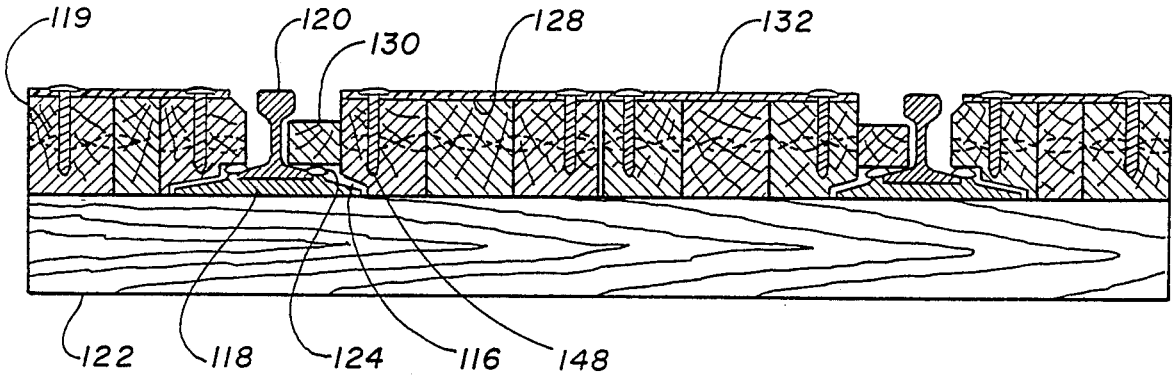
FIG. 5 is an enlarged cross sectional view taken through line V—V in FIG. 2.
Figure 6:
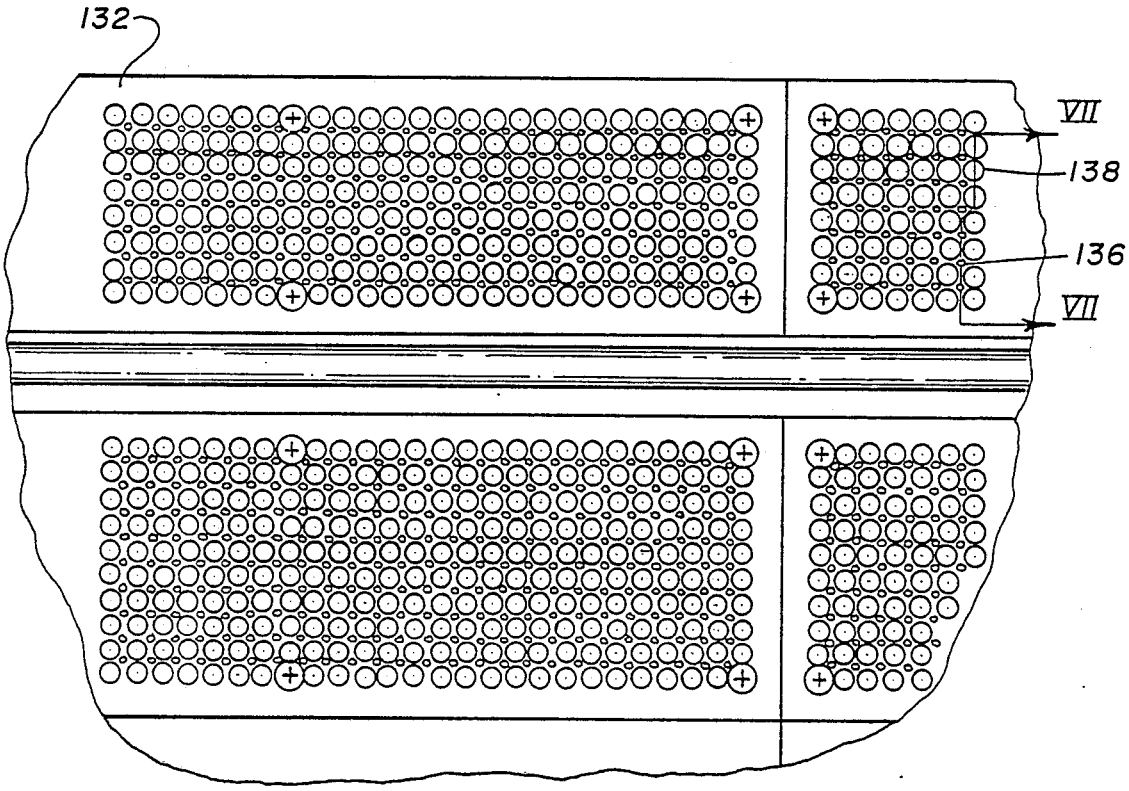
FIG. 6 is an enlarged view of the area within circle VI of FIG. 2.
Figure 7:
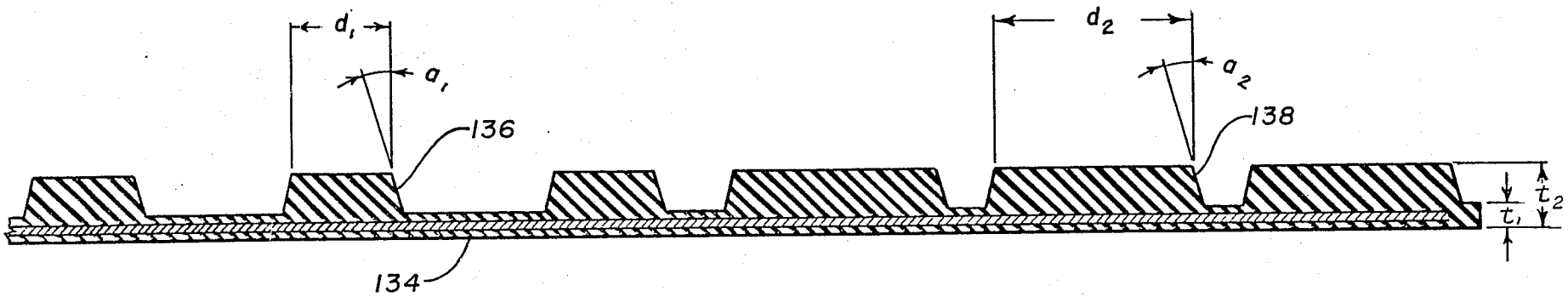
FIG. 7 is an enlarged cross sectional view taken through line VII—VII in FIG. 6.
Figure 8:
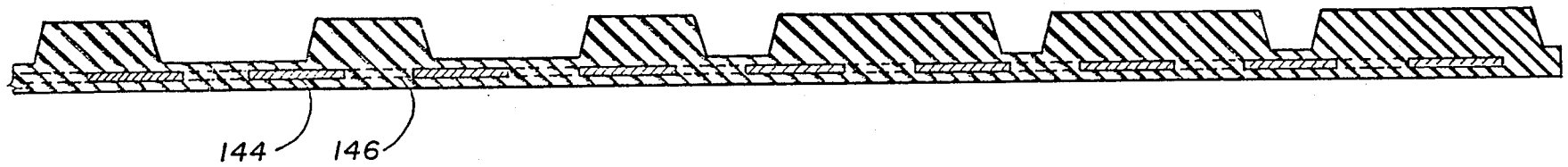
FIG. 8 is an enlarged cross sectional view corresponding to FIG. 7 showing an alternate embodiment of the crossing of the present invention.

In the preferred embodiment planks 117, 117', 117''' and 117''' are fixed to crosstie 122 by means of washer head lag screws as at 126 (FIG. 3). Also provided are wood filler blocks as at 130 (FIG. 4) which span the gap between the rail and the panels. Surface 128 of the panels is capped with a polymer covering cap 132. This covering is shown in detail in FIG. 7, and it is made up of a composite of the polymer 132 which is preferably rubber and a plate 134. As shown in FIG. 7, the planar metal reinforcing plate 134 is embedded in a solid planar base of the polymer 132. The covering is also provided with treads as at 136 and 138. Between the treads the covering is preferably about a 3/16 inch in thickness ($t_1$ on FIG. 7). Through the treads the covering is preferably about a ½ inch in thickness ($t_2$ on FIG. 7). The steel plate is preferably about 1/16 inch in thickness. The small and large treads are respectively about ¾ inch and 1½ inch in diameter ($d_1$ and $d_2$ on FIG. 7). The small and large treads as they appear on the covering cap are shown in the plan view of FIG. 6. These treads are also sloped about 15° from the horizontal ($a_1$ and $a_2$ in FIG. 7). As is apparent from the above described dimensions and as shown in the drawings, most of the grade crossing space between the upper surface of the cross ties and the upper surface of the rails is filled with the permanently affixed panels. The removable polymeric covering cap is very thin compared to the thickness of the panels. When the rubber is bonded to the steel during manufacture its temperature is about 320° F. After the covering is put into service, the highest ambient temperature to which it will ordinarily be exposed is about 140° F. Thus the steel plate will ordinarily keep the rubber stretched to a point that it will not be further expanded as a result of ambient temperature. Buckling of the covering and its consequential damage from vehicular traffic will, therefore, be avoided. It will be appreciated that, in addition to rubber, other polymeric materials which harden at temperatures above 140° F. may also be used in this covering. An alternate embodiment of this covering is shown in FIG. 8. This covering is substantially identical to the covering shown in FIG. 7 except in the steel plate 144 has perforations as at 146 which help to secure the rubber to steel plate 144.

Referring particularly to FIG. 3, it will be seen that the covering is removably fixed to the surface 128 by means of a plurality of dome head spikes as at 140. It will be understood that these dome head spikes are not the same washer head by screws as at 126 by means of which the planks 117, 117', 117'' and 117''' are fixed to the crosstie. It can be seen that as the polymer cap deteriorates, it can be easily removed and replaced without disturbing the planks or the panels. It is understood that the crossing of the present invention can be used at multiple track crossings by repeating the structure herein described for each set of tracks. Also, the width and length of the crossing will be determined by the dimensions where the crossing will be used.

Although the invention has been described with a certain degree of particularity, it is to be understood that the present disclosure has been made only as an example and the scope of the invention is defied by what is hereinafter claimed.

What is claimed is:

1. A highway railroad grade crossing for railroad tracks with rails affixed to crossties having exposed upper surfaces between said rails and upper surfaces outwardly extending beyond the outer edge of each rail, comprising a plurality of panel means adapted to be permanently fixed to at least one of the upper surfaces of said crossties and being of a predetermined height; and a removable and replaceable wear surface means capped on said panel means, comprised of a polymer having a solid planar base with a planar metal reinforcing plate imbedded therein and with treads extending upwardly from said base, said wear surface means being of a predetermined height such that the upper surface of the wear surface means is co-planar with the top of the rails, and where the height of said wear surface means is substantially smaller than the height of said panel means.

2. The grade crossing of claim 1 wherein the polymer is rubber.

3. The grade crossing of claim 1 wherein the polymer is a material that hardens at above about 140° F.

4. The grade crossing of claim 1 wherein the wear surface means is from about 3/16 inch to about ½ inch in height.

5. The grade crossing of claim 1 wherein the metal plate is a steel plate.

6. The grade crossing of claim 5 wherein the steel plate is about 1/16 inch in thickness.

7. The grade crossing of claim 6 wherein the steel plate has perforations.

8. The grade crossing of claim 1 wherein said panel means is comprised of a plurality of wooden planks affixed side by side with a steel twist dowel.

9. The grade crossing of claim 8 wherein said wooden planks have a height of 8½ inches, a width of 7 inches and a length of 96 inches.

10. The grade crossing of claim 9 wherein said wear surface means has a height from 3/16 inches to ½ inch.

11. The grade crossing of claim 1 wherein said panel means has a height equal to at least 5/6 of the space between the upper surface of the crossties and the top of the rails.

* * * * *